US006544303B2

(12) United States Patent
Calzada

(10) Patent No.: US 6,544,303 B2
(45) Date of Patent: Apr. 8, 2003

(54) HEAT ACTIVATED PERFUME CANDLE

(75) Inventor: Jose Francisco Calzada, Guatamala (GT)

(73) Assignee: Xanadu Candle International Limited, Road Town Tortola (VG)

( * ) Notice: Subject to any disclaimer, the term of this patent is extended or adjusted under 35 U.S.C. 154(b) by 0 days.

(21) Appl. No.: 09/769,595

(22) Filed: Jan. 25, 2001

(65) Prior Publication Data

US 2002/0139041 A1 Oct. 3, 2002

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS 3,958,917 A * 5/1976 Naz ..... 422/126
4,110,261 A * 8/1978 Newland ..... 424/76.4
4,568,270 A * 2/1986 Marcus et al. ..... 422/126
5,395,233 A * 3/1995 Karp ..... 431/126
5,882,363 A * 3/1999 Spaulding et al. ..... 431/288
6,054,517 A * 4/2000 Spaulding et al. ..... 44/275
6,063,144 A * 5/2000 Calzada et al. ..... 431/126
6,068,472 A * 5/2000 Freeman et al. ..... 431/288
6,276,925 B1 * 8/2001 Varga ..... 431/288

* cited by examiner

*Primary Examiner*—Cephia D. Toomer
(74) *Attorney, Agent, or Firm*—Robert M. Schwartz

(57) ABSTRACT

A composite scented candle has a high load scented shell and a core candle with a similar or lesser fragrance load. The inside candle can be wax, paraffin, gel oil or polyamide-based and can be scented or unscented. The outside shell can be made of paraffin wax and a reinforcement having a melting point of at least 70° C. and is scented at a level so that fragrance is continuously released without burning and is further activated by lighting the core candle. The composite scented candle can be presented as a pillar candle.

31 Claims, 3 Drawing Sheets

HEAT ACTIVATED PERFUME CANDLE

BACKGROUND OF THE INVENTION

1. Field of the Invention

This invention relates to a candle having a favorable combination of properties including an enhanced pleasing odor as supplied and a further enhanced pleasing odor while burning.

2. Prior Art

The art of candlemaking has been practiced for centuries. The traditional technique still in use includes embedding a wick in a mass of combustible material and generating illumination by lighting the wick, causing the burning wick to contact and melt the exposed surface of the combustible material which then is absorbed by the wick and so sustains the flame until the combustible material is consumed or the burning candle is deliberately extinguished.

With the introduction of electric lighting the utilitarian illumination of the home and the workplace with candles declined, while the use of candles to provide a variety of esthetically satisfying effects of religious inspiration, festivity, or relaxation and intimacy has become the principal use of candles. For such esthetically driven use a pleasing odor is an important consideration, and many varieties of scented candles have been provided. While such scented candles may have an agreeable odor encouraging their purchase, the agreeable odor may dissipate if the candle is stored for any length of time, and as the candle burns the fragrance may be consumed before the candle as a whole.

A conventional fragrance candle is made from petroleum paraffin or waxes. More recently, hydrocarbon gels, gelling agents with oil and polyamides have been used as base materials, but these recently introduced candlemaking materials have neither appreciably enhanced the pleasing odor characteristics of scented candles nor overcome the physical constraints and problems that limit the effectiveness of scented candles.

As noted, for example, by Marcus et al in U.S. Pat. No. 4,568,270, it is difficult to incorporate enough fragrance oil into a candle to ensure an abundant release of fragrance without making the candle tacky or oily and depriving the candle of sufficient structural properties to resist damage and stand freely. Thus during the summer months fragrance candles can become so soft that they lack sufficient structural properties to stand freely, and become unacceptable without being protected by a rigid container. Marcus et al disclosed a free standing fragrance candle comprising an outer shell, an inner core and a wick; the shell being formed of a material selected from the group consisting essentially of paraffin, a wax, a mixture thereof, and any of the preceding materials in combination with fragrance oil; the shell having a melting point high enough that the shell stands freely and is not tacky at room temperature; the core being formed of fragrance oil and a carrier therefor; the fragrance oil in the core constituting from 5% to 12% of the total weight of the core; the carrier being a material selected from the group consisting essentially of petrolatum, a low melting point wax, and a mixture thereof; the core having a melting point substantially lower than the melting point of the shell and low enough to form a molten pool within the shell and to ensure a substantial release of fragrance into the surrounding atmosphere as the candle burns; and the shell constituting a container and providing structural support for the core. It is also disclosed that fragrance oil is always incorporated in the core, and preferably, though not necessarily, also in the shell.

When fragrance oil is incorporated in the shell, it is preferably in the same proportion there as in the core in order to prevent dilution of the fragrance oil in the core by molten wax from the shell as the candle burns. Thus, in the disclosed candle it is the core that provides for release of fragrance and the shell that imparts structural properties.

A need therefore exists for a novel type of candle able to provide enhanced release of pleasing odor to its surroundings without being burned as well as during the actual burn of the candle, and in particular to do so without adversely affecting other favorable properties of the candle and without requiring disproportionately large quantities of costly fragrance material.

SUMMARY OF THE INVENTION

In accordance with this invention, there is provided a composite candle made of a high load fragrance shell surrounding a core candle which contains a lesser loading of fragrance and need not contain any fragrance. Before the candle is burned, the unconventionally high fragrance level in the shell affords enhanced release of pleasing odor to the surroundings. When the candle is burning, the heat of the lighted core further enhances the fragrance release from the shell, by creating a driving force for the fragrance from the shell to the external surface and also through the pool of the core candle, including the material that can melt from the inner surface of the shell. As a result, the release of pleasing odor from the candle of the invention is enhanced compared to a candle with fragrance uniformly distributed therein, even in greater concentration.

The candle of this invention, accordingly, comprises at least one wick surrounded by a core comprising a combustible candle core composition, which is surrounded by a mechanically sturdy and non-sticky fragrance-releasing shell comprising a combustible candle shell composition and a high level of at least one fragrance, selected from the group consisting of natural and synthetic fragrances. The concentration of fragrance in the shell is greater than 10% and preferably at least 15% by weight and can range as high as 60% by weight.

A candle according to the invention can be presented as a self-supporting stand alone candle (a so-called "pillar" candle) or as a candle in a container, where he shell itself can constitute the container. The core within can be contiguous with the shell or removably placed within, with a gap of predetermined width between the shell and the core. The candle according to this invention can be of any desired size and shape. In particular, a candle according to the invention can be higher than it is wide, or wider than it is high. The candle according to the invention can be uniform in cross-section or vary in cross-section along its height.

The cross-section of the core and the cross-section of the shell can be concentric circles with the wick at the center, or any desired cross-section according to the intended shape.

Thus, the construction of a heat-activated candle according to the invention as a combustible core surrounded by a shell having a high concentration of fragrance is particularly suitable for creating a great variety of esthetically pleasing and decorative shapes for the candle of the invention, including cylindrical, spherical, polygonal, tear-drop and free-form abstract shapes as well as human and animal shapes (such as a hand, a torso, or the head of a cat) and shapes of familiar inanimate objects (such as a telephone or a replica of a well-known building). The shell surrounds the core for at least 50% of its height and can extend up to the full height of the core and even higher, thus constituting a shade surrounding the flame when the candle burns.

Accordingly, the shell can surround the top of the core and at least a portion of its sides, or the shell can surround the bottom of the core and at least a portion of its sides.

The relative dimensions of the shell and the core in the candle according to the invention are defined such that the shell is at least 2 mm thick. The thickness of the shell need not be uniform throughout. The upper limit for the dimensions of the shell is defined such that the dimension of the shell as a fraction of the combined dimensions of the shell and the core measured outward from the wick can be from 2% to 75% of the combined dimensions, preferably from 5% to 20% of the combined dimensions.

The term "combustible" is used in its conventional meaning to indicate that the material burns when ignited in the ordinary manner of a candle. The term is not used in its regulatory sense as promulgated by the US Department of Transportation to indicate a material having a flash point in a defined range. In fact, candles according to the invention desirably have a flash point higher than that of a regulatory "combustible" material.

The terms "clear" and "transparent" are used with their conventional meanings to indicate that object placed behind or within a candle (for example the wick or a decorative icon) can be discerned by a viewer. The term "compatible" is used to indicate that the fragrance is retained within the combustible shell composition according to the invention over long periods of time without loss of clarity, exudation, or loss of fragrance quality or intensity, as determined, for example, by an accelerated exposure test carried out at 40° C. for ten days.

The high fragrance load shell according to the invention can be made of a composition comprising paraffin wax and at least one reinforcement having a melting point of at least 70° C. The reinforcement is a material having a pleasing odor or no odor and burns with minimal smoke formation. The reinforcement is preferably selected from the group consisting of aliphatic hydrocarbon mixtures having higher melting points than paraffin wax, aliphatic hydrocarbon polymers, copolymers incorporating a major amount of an aliphatic hydrocarbon monomer and a minor amount of an ester monomer, and fatty acid amides including amides of monobasic fatty acids and dimer acid based polyamide resins. The shell can be colored and/or decorated as desired or plain, with or without inclusions.

The high fragrance load shell of the candle of the invention can also be made of a substantially non-paraffin combustible composition consisting essentially of at least 30 parts by weight of stearic acid, at least 5 parts by weight of vegetable-derived wax having a melting point of at least 50° C., 0–50 parts by weight of at least one hardened vegetable oil, more than 10 parts by weight of at least one fragrance and 0 to 1 part by weight of at least one oxidation inhibitor. Hardened vegetable oils include, for example, hydrogenated vegetable oils and vegetable oils having melting points increased by interesterification.

The term "substantially non-paraffin" is used to include, in addition to the substantial absence of paraffin, such properties of a candle deemed desirable by people concerned with the protection and enjoyment of the environment as a pleasing odor as supplied, a pleasing odor while burning and upon being extinguished, substantial absence of smoke and unpleasant odor while burning and upon being extinguished, taken together with a composition constituted of at least 95% by weight of vegetable or otherwise renewable resources of natural origin and not more than 5% by weight of paraffin or otherwise non-renewable resource derived materials.

The term "consisting essentially of" is used in its art-recognized sense to express that the composition is open to the inclusion of only such additional ingredients as do not adversely affect its essential properties as defined.

The high fragrance load combustible candle shell can also be made of a clear transparent combustible candle shell composition comprising at least 81% by weight of at least one dimer acid based polyamide resin and 0–19% by weight of at least one solvent for said polyamide resin and containing more than 10% by weight of the shell of at least one fragrance.

The combustible candle core according to the invention can be made of a combustible composition that is the same as the high fragrance load shell composition, or of a different combustible composition such that any interactions that occur between the shell and the core do not adversely affect the favorable properties of the shell or the core, in particular the pleasing appearance and dry feel of the shell. The core can be, but need not be, transparent.

The combustible candle core can, accordingly, be made of any conventional combustible candle composition, such as that of a typical paraffin base candle. The combustible candle core can also be made of the non-paraffin candle composition disclosed in commonly assigned U.S. Pat. No. 6,063,144 whose entire disclosure is here incorporated by reference.

BRIEF DESCRIPTION OF THE DRAWINGS

Each of FIGS. 1–6 represents in diagrammatic form a vertical cross-section of a candle having a high fragrance-loaded shell according to the invention along a plane including the wick. In each of these figures, the wick is represented by line 1, the combustible candle core is represented by areas 2, and the high fragrance-loaded shell is represented by areas 3.

DESCRIPTION OF PREFERRED EMBODIMENTS

Figure 1:
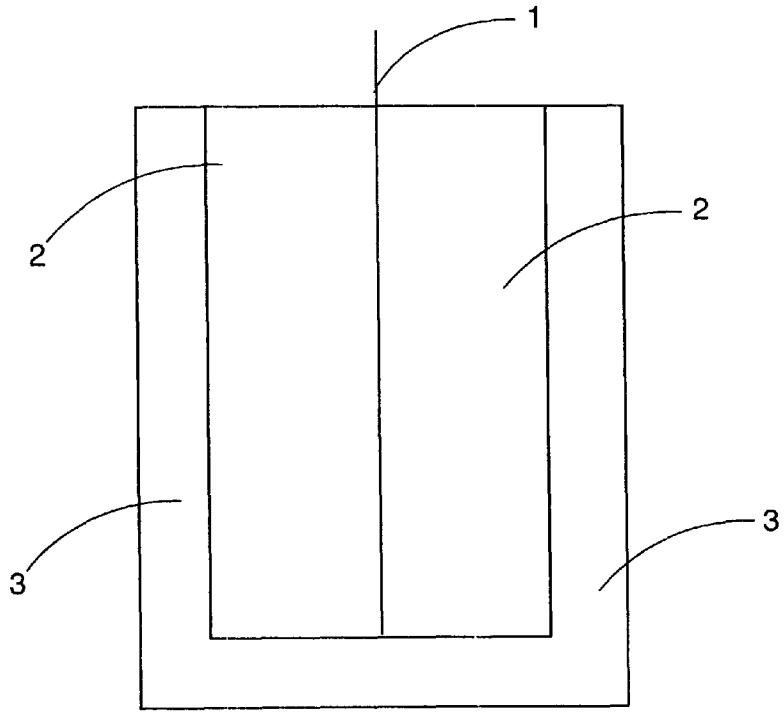
In FIG. 1, the shell 3 encompasses the bottom and the full height of the candle core 2.
Figure 2:
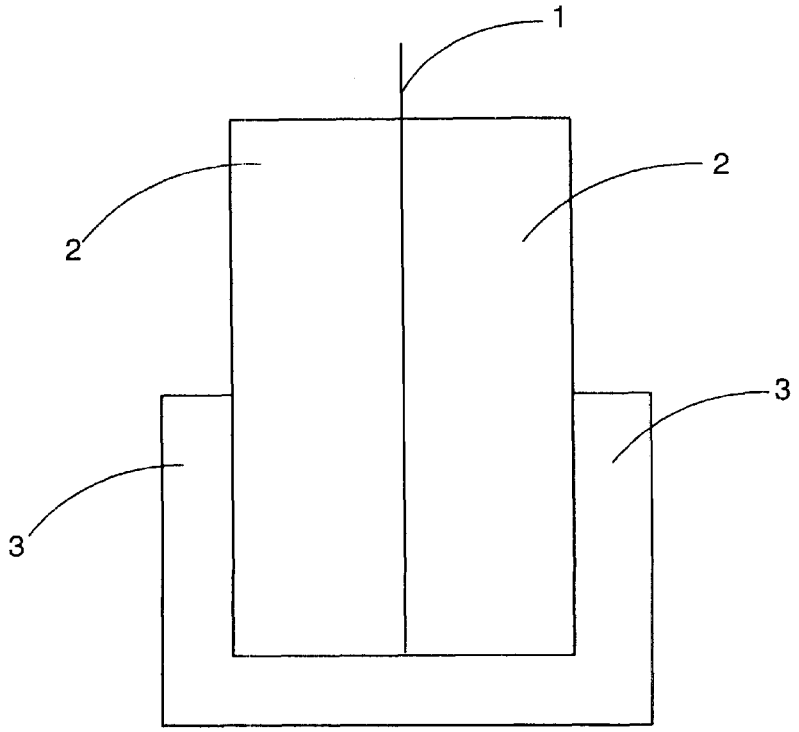
In FIG. 2, the shell 3 encompasses the bottom and a major portion of the height of the core 2.
Figure 3:
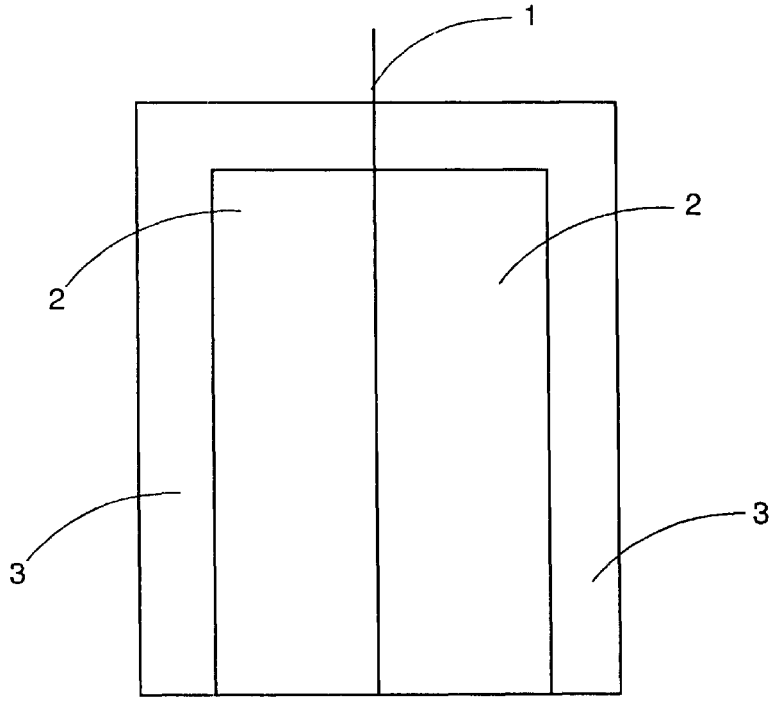
In FIG. 3, the shell 3 encompasses the full height of the core 2 and the top of the core 2.
Figure 4:
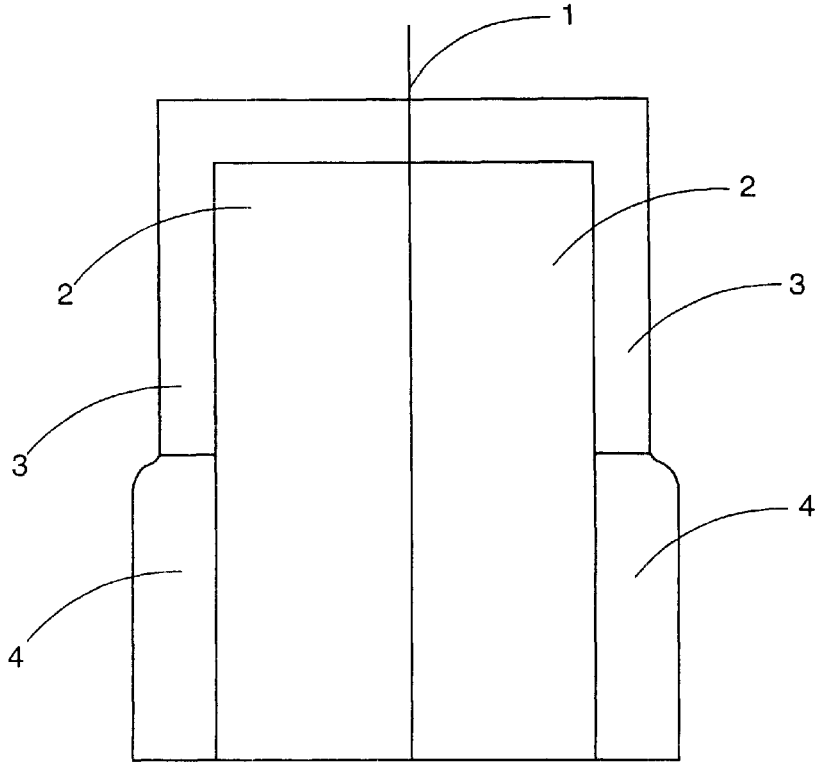
In FIG. 4, the shell 3 comprises discrete sections of varying thickness encompassing the full height of the core 2 and the top of the core 2, wherein the thicker sections of the shell are represented by areas 4.
Figure 5:
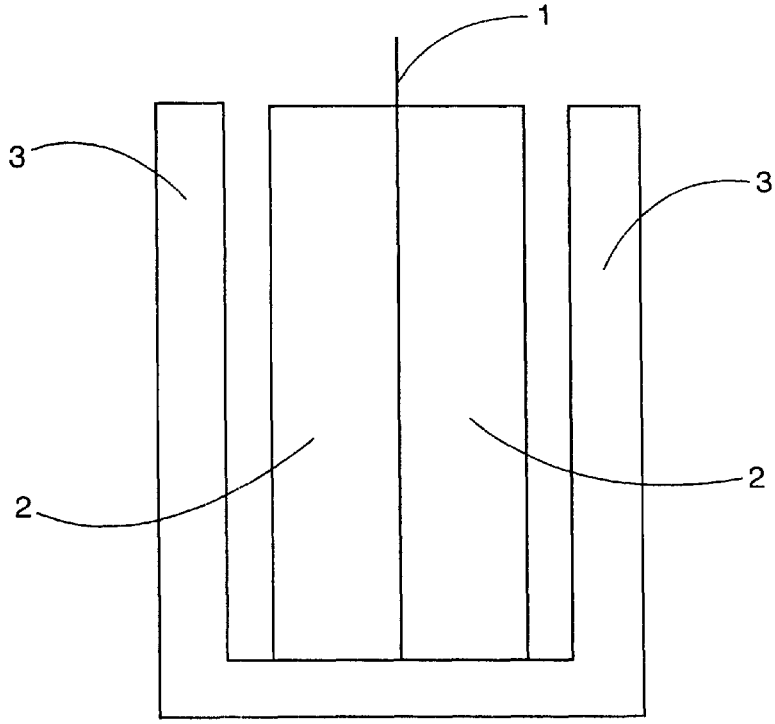
In FIG. 5, the shell 3 is spaced away from the core 2 and encompasses the bottom and the full height of the core. 2
Figure 6:
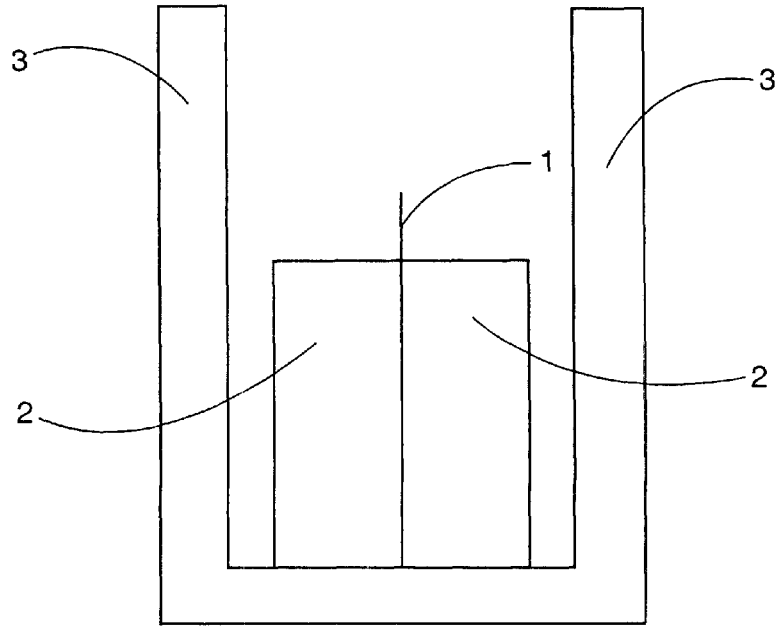
In FIG. 6, the shell is spaced away from the core 2 and extends beyond the full height of the core 2.

When the high fragrance load shell according to the invention is made of a composition comprising paraffin wax and at least one reinforcement having a melting point of at least 70° C., and the reinforcement is an aliphatic hydrocarbon mixture having a higher melting point than paraffin wax, the mixture can be, for example, a petroleum wax known as a microcrystalline wax or as an intermediate wax. Whereas paraffin waxes consist of mixtures of alkanes of which the majority are normal alkanes having from about 20 to about 50 carbon atoms, the intermediate waxes are essentially a continuation of the paraffin range extending to 60 or more carbon atoms in chain length and containing from about 30 to about 60% of branched chain hydrocarbons, and the microcrystalline waxes have from the low 30s to well over 80 carbon atoms in the hydrocarbon molecule and an even higher proportion of branched chain hydrocarbons than the intermediate waxes.

When the reinforcement of the high fragrance shell of the invention is an aliphatic hydrocarbon polymer, the polymer can be, for example, an alpha-olefin polymer such as polyethylene, poly-1-butene, poly-1-decene, a polymer of mixed long chain alpha-olefins having 20 or more carbon atoms, a copolymer of ethylene with a higher alpha-olefin, or a copolymer of two or more alph-olefins having 3 or more carbon atoms. Suitable polyethylenes include low density polyethylene, high density polyethylene, polyethylenes of molecular weights in the range from 500 to 10000 daltons and melting points in the range from 90–105° C., and oxidized grades of poly ethylene having acid numbers in the range of 10–30 milligrams KOH per gram. Combinations of two or more such polymers can be used. A polymer of 1-decene having a melting point of approximately 74° C. is particularly preferred.

When the reinforcement of the high fragrance shell of the invention is a copolymer of ethylene with a minor amount of an unsaturated ester, the ester can be, for example, an ester of acrylic or methyacrylic acid with an aliphatic alcohol having 1–8 carbon atoms such as methyl methacrylate, ethyl acrylate, butyl acrylate and 2-ethylhexyl methacrylate; and a vinyl ester of an aliphatic carboxylic acid such as vinyl acetate, vinyl 2-ethylhexanoate, vinyl neodecanoate, and vinyl stearate. The amount of the ester co-monomer can range up to about 30% and is preferably in the range from 6 to 25%. Combinations of two or more such polymers can be used. A particularly preferred polymer of this type is a copolymer of ethylene with 10–25% vinyl acetate.

When the reinforcement of the high fragrance shell of the invention is a fatty acid amide, the amide can be, for example, oleamide, palmitamide, stearamide, N-stearyl stearamide, 12-hydroxystearamide, N,N,-bis (2-hydroxyethyl)stearamide, N,N'-ethylenebis(oleamide) and N,N'-ethylenebis(stearamide).

When the reinforcement of the high fragrance shell of the invention is a polyamide resin based on dimer acid, the polyamide resin can be a neutral or slightly acidic (i.e. not amine-terminated) polyamide having a molecular weight in the range from 1000 to about 60000 daltons, as obtained, for example, from the polymerization of a diamine with one or more dicarboxylic acids of which at least one is dimer acid as defined. Dicarboxylic acids which can be included in the polyamide according to the invention include oxalic acid, succinic acid, glutaric acid, adipic acid, 2-methylglutaric acid, azelaic acid, sebacic acid, isophthalic acid, and terephthalic acid. Diamines which can be included in the polyamide according to the invention include ethylenediamine, propylene-1,2-diamine, 1,6-diaminohexane, piperazine, N, N'-bis(2-aminoethyl)piperazine, and ether-interrupted alkylenediamines such as the polyoxyalkylenediamines disclosed, for example, in U.S. Pat. No. 6,077,900 here incorporated by reference.

Dimer acid based polyamide resins in which dimer acid is at least in part hydrogenated are particularly preferred.

The relative proportions of paraffin wax and reinforcement in the high fragrance candle shell of the invention are such that the shell preferably contains 20 to 70 parts by weight of paraffin wax and 2 to 60 parts of reinforcement. A particularly preferred embodiment contains 20 to 70 parts by weight of paraffin wax, 0 to 40 parts by weight of microcrystalline wax, 0 to 5 parts by weight of poly-1-decene and 0 to 2 parts by weight of oleamide, provided that the parts by weight of microcrystalline wax, poly-1-decene and oleamide are not all zero.

When the high fragrance level combustible shell of the candle according to the invention is made of a substantially non-paraffin composition, the stearic acid, vegetable derived wax, and vegetable oil ingredients of such composition can be any of those disclosed in commonly assigned U.S. Pat. No. 6,063,144 referred to above.

When the high fragrance level combustible shell of the candle according to the invention is made of a clear transparent composition containing a dimer-acid based polyamide resin, such resin can be any of those disclosed above as reinforcement of a paraffin based shell composition. When such composition containing a dimer-acid based polyamide resin includes a solvent, the solvent when present is a liquid of high polarity, low polarity, or intermediate polarity, or a mixture of such liquids, that is miscible with the polyamide component of the combustible candle shell composition, such that up to 19 parts by weight of the solvent can be admixed with 81 parts by weight of polyamide and afford a clear composition at the intended use temperature (usually the normal ambient temperature) of the candle according to the invention. To remain part of the shell composition throughout its useful life the solvent should have a boiling point of at least 180° C.

High polarity solvents include alcohols having 8–24 carbon atoms, ether alcohols having 6–36 carbon atoms, and aliphatic carboxylic acids having 8–24 carbon atoms. Low polarity solvents include hydrocarbons having 10–50 carbon atoms. Intermediate polarity solvents include ethers and carboxylic acid esters having 10–60 carbon atoms.

In a preferred embodiment, emulsifiers can be present in the shell, in the core, or both, suitably in a concentration up to about 5% by weight.

Emulsifiers when present are preferably nonionic and include, for example, glyceryl monooleate, glyceryl monostearate, propylene glycol monooleate, sorbitan monolaurate, and ethoxylated alcohols and alkylphenols with 4–14 ethylene oxide units.

Fragrance, for the purpose of this invention, embraces any fragrance compatible with the shell, as well as any compatible material classified as flavor, which can be natural or synthetic in origin. Suitable natural and synthetic fragrance/flavor substances include those compiled by the US Food and Drug Administration in Title 21 of the Code of Federal Regulations, Sections 172.510 and 172.515 respectively. Particularly suitable fragrances include basil, bergamot, citrus, jasmine, lemongrass, rosemary, and vanilla. The proportion of fragrance in the high fragrance load shell composition is determined by the strength of the particular fragrance to be used, and is generally in the range from more than 10% by weight to as much as 60% by weight, preferably from 15% by weight to 45% by weight. When present in the core, the proportion of fragrance is generally in the range from 0.1 to 10% by weight, preferably from 0.5 to 5% by weight.

Oxidation inhibitor and/or ultraviolet absorber when present can be odorless or possess an agreeable odor. Suitable oxidation inhibitors include Vitamin C ascorbic acid and Vitamin E tocopherol as natural prototypes of the category, as well as the vitamin-inactive isomer erythorbic acid, oxy-acids of phosphorus such as phosphoric acid and polyphosphoric acid, aliphatic hydroxypolycarboxylic acids such as citric acid, malic acid, and tartaric acid, EDTA and its sodium and calcium salts, and alkyl-substituted phenols such as BHT, BHA, thymol, carvacrol, 4,4'-butylidenebis (2-t-butyl-5-methylphenol), 1,1,3-tris(2-methyl-4-hydroxy-5-t-butylphenyl)butane and 3,5-di-t-butyl-4-hydroxyphenylpropionic acid and its esters with C1–C18 monohydric alcohols or 2–6 functional polyhydric alcohols. Suitable ultraviolet absorbers absorb radiation in the range of wavelengths from about 270 nm to about 400 nm and include salicylic acid esters, 2-hydroxy-4-alkoxybenzophenones, and substituted derivatives of 2 (2'-hydroxy-5'-alkylphenyl)benzotriazole. When present, the proportion of oxidation inhibitor and/or ultraviolet absorber is generally in the range from 0.005% to 1% by weight, preferably from 0.01% to 0.5%.

The high fragrance load candle shell according to the invention can be made by any of three basic procedures or their combinations:

1) Molding of the shell: using a mold with the shape of the final shell. The mold can be made of rubber or silicone material or be a rigid metal mold. The mold can give a smooth, frosted (sand blasted molds or rubbery molds) or relief finish to the candle.
2) Partially emptying a candle mold filled with the shell mixture, in order to leave the faster cooling layer. As in the previous case, the mold can give smooth, frosted (sand blasted molds or rubbery molds) or relief finish to the candle.
3) Extrusion: Here, appearance can be varied according to the die used.

When inclusions are required, these are placed in the shell during the pouring or cooling operations. The surface can also be painted once the shell hardening point is reached.

Once the shell is prepared, it can be filled with the candle core mixture (wax, paraffin or polyamide-based, with the wick) or it can be used in the form of a shade to put a smaller, previously made candle inside. This is the core section of the composite candle and it can be scented and/or colored as desired.

The following Examples illustrate the invention without limiting its scope as defined by the appended claims. All parts are by weight.

EXAMPLES 1–6

The ingredients of the high fragrance level candle shell compositions shown below were charged to a heated mixing vessel and warmed with stirring until a homogeneous melt was obtained. The melt was then discharged into pre-cooled metal candle molds which were rotated to produce a layer of material approximately 5 mm thick in contact with the mold, allowed to cool and solidify, and removed.

The ingredients of the candle shell compositions were as follows:

| Example | 1 | 2 | 3 | 4 | 5 | 6 |
|---|---|---|---|---|---|---|
| Paraffin Wax Melting Point 62° C. | 58.5 | 56 | 53.5 | 51 | 25.5 | none |
| Paraffin Wax Melting Point 60.5° C. | none | none | none | none | none | 64 |
| Micro-crystalline wax | 17.5 | 15 | 12.5 | 10 | 37.5 | none |
| Polymer alkane (polymer of 1-decene) note 1 | 3 | 3 | 3 | 3 | 2 | none |
| Polyethylene | 5 | 5 | 5 | 5 | 5 | 5 |

-continued

| Example | 1 | 2 | 3 | 4 | 5 | 6 |
|---|---|---|---|---|---|---|
| Oleamide | 1 | 1 | 1 | 1 | none | 1 |
| Antioxidant | 0.003 | 0.003 | 0.003 | 0.003 | none | none |
| Fragrance | 15 | 20 | 25 | 30 | 30 | 30 |

Note 1:
VYBAR ® polymer (Baker Petrolite Co.))

A wick was subsequently inserted into each of the high fragrance level shells obtained from the above shell compositions, followed by a melted core composition made up as follows:

Paraffin Wax Melting Point 62° C. 72 parts by weight
Paraffin Wax Melting Point 54° C. 20
Microcrystalline wax 1.8
Polymer alkane(polymer Of 1-decene) note 1 1.1
UV Inhibitor 0.1
Antioxidant 0.003
Fragrance 5
Note 1: VYBAR® polymer (Baker Petrolite Co.).

When this was allowed to cool, intensely fragrant free standing (pillar) candles were obtained.

EXAMPLE 7

A high fragrance vegetable base (non-paraffin) candle was prepared having a shell made of the following composition, in parts by weight:

| | |
|---|---|
| Stearic Acid | 75 parts by weight |
| Hydrogenated Castor Oil | 10 |
| Candelilla Wax | 5 |
| Antioxidant | 0.003 |
| U. V. Protector | 0.1 |
| Fragrance | 11 |

A wick was subsequently inserted into the high fragrance level shells obtained from the above shell composition, followed by a melted core composition made up as follows:

| | |
|---|---|
| Stearic Acid | 83 parts by weight |
| Hydrogenated Castor Oil | 10 |
| Candelilla wax | 5 |
| Antioxidant | 0.003 |
| U. V. Protector | 0.1 |
| Fragrance | 2 |

Advantages of the heat-activated candle according to the invention include

1) Good burning property, since the candle core is selected from compositions known for good burning;
2) Good fragrance release from the unlighted composite candle, provided by the candle shell;
3) Enhanced fragrance release from the lighted composite candle, provided through improved fragrance transfer to the surface of the shell and to the pool;
4) Good sensory properties because of the smooth external surface of the composite candle and also because of the possibility of decorations in the shell (included in the material of the shell, painted on its faces, relief motifs, etc).

What is claimed is:

1. A candle comprising at least one wick surrounded by a core comprising a combustible candle core composition, which is surrounded by a fragrance-releasing shell comprising a combustible candle shell composition and at least 15% by weight of at least one fragrance compatible with the shell, selected from the group consisting of natural and synthetic fragrances, provided that said core contains a lesser loading of fragrance than said shell.

2. The candle according to claim 1, in which the concentration of fragrance in the shell is in the range from 15% to 60% by weight.

3. The candle according to claim 1, having a cylindrical, spherical, polygonal, tear-drop or free-form abstract shape.

4. The candle according to claim 1 having a human or animal shape.

5. The candle according to claim 1, having a shape of an inanimate object.

6. The candle according to claim 1, in which the cross-sections of the shell and the core are concentric circles with the wick at the center.

7. The candle according to claim 1, in which said shell extends for at least 50% of the height of said core.

8. The candle according to claim 7, in which said shell surrounds the top and at least a portion of the sides of said core.

9. The candle according to claim 7, in which said shell surrounds the bottom and at least a portion of the sides of said core.

10. The candle according to claim 7, in which said shell extends beyond the top of said core.

11. The candle according to claim 1, in which said shell and said core are contiguous.

12. The candle according to claim 1, in which said shell and said core are separated by a gap.

13. The candle according to claim 1, in which the thickness of said shell is at least 2 millimeters.

14. The candle according to claim 1, in which the dimension of the shell as a fraction of the combined dimensions of the shell and the core measured outward from the wick is from 2% to 75% of the combined dimensions.

15. The candle according to claim 1, in which the dimension of the shell as a fraction of the combined dimensions of the shell and the core measured outward from the wick is from 5% to 20% of the combined dimensions.

16. A candle according to claim 2 in which said combustible candle shell composition comprises paraffin wax and at least one reinforcement having a melting point of at least 70° C.

17. The candle according to claim 16, in which said reinforcement is selected from the group consisting of intermediate waxes, microcrystalline waxes, aliphatic hydrocarbon polymers, copolymers incorporating a major amount of an aliphatic hydrocarbon monomer and a minor amount of an unsaturated ester monomer, and amides selected from the group consisting of fatty acid amides and dimer acid based polyamide resins.

18. The candle according to claim 17, in which said aliphatic hydrocarbon polymer is polyethylene.

19. The candle according to claim 17, in which said hydrocarbon polymer is poly(1-decene).

20. The candle according to claim 17, in which said copolymer is a copolymer of ethylene and vinyl acetate.

21. The candle according to claim 17, in which said fatty acid amide is oleamide.

22. The candle according to claim 1, in which said core composition is scented.

23. The candle according to claim 1, in which said combustible shell composition comprises at least 81% by weight of at least one dimer acid based polyamide resin and 0–19% by weight of at least one solvent for said polyamide resin.

24. A candle comprising at least one wick surrounded by a core comprising a combustible candle core composition, which is surrounded by a fragrance-releasing shell comprising a combustible candle shell composition and more than 10% by weight of at least one fragrance compatible with the shell, selected from the group consisting of natural and synthetic fragrances, in which said combustible shell composition is a substantially non-paraffin combustible composition consisting essentially of at least 30 parts by weight of stearic acid, at least 5 parts by weight of vegetable-derived wax having a melting point of at least 50° C., 0–50 parts by weight of at least one hardened vegetable oil, more than 10% by weight of at least one fragrance and 0 to 1 part by weight of at least one oxidation inhibitor.

25. The candle according to claim 1, in which said core composition is unscented.

26. The candle according to claim 1, in which said shell composition additionally includes 0–5 parts by weight of at least one emulsifier and 0 to 1 part by weight of at least one preservative, provided that the sum of said parts by weight is greater than zero.

27. The candle according to claim 26, in which said preservative is selected from the group consisting of ultraviolet absorbers and oxidation inhibitors.

28. The candle according to claim 1, which is free standing.

29. The candle according to claim 2, in which said shell composition comprises 20 to 70 parts by weight of paraffin wax and 2 to 60 parts of reinforcement.

30. The candle according to claim 29, in which said shell composition comprises 20 to 70 parts by weight of paraffin wax, 0 to 40 parts by weight of microcrystalline wax, 0 to 5 parts by weight of poly-1-decene, 0–5 parts of polyethylene and 0 to 2 parts by weight of oleamide, provided that the parts by weight of microcrystalline wax, poly-1-decene, polyethylene and oleamide are not all zero.

31. The candle of claim 30, consisting essentially of 25 to 65 parts by weight of paraffin wax having a melting point of 60–64° C., 10–40 parts by weight of microcrystalline wax, 0–3 parts by weight of poly-1-decene, 5 parts by weight of polyethylene, 0–1 part by weight of oleamide, 0–0.003% of antioxidant and 15–30 parts by weight of fragrance, provided that the parts by weight of poly-1-decene and oleamide are not both zero.

* * * * *